362-110
9/7/82 4,348,716

United States Patent [19]

Storm et al.

[11] 4,348,716

[45] Sep. 7, 1982

[54] FLASHLIGHT GUN MOUNT

[76] Inventors: Nelson Storm; Gregory A. Storm, both of 213 Perry, Rossville, Ill. 60963

[21] Appl. No.: 171,322

[22] Filed: Jul. 23, 1980

Related U.S. Application Data

[63] Continuation-in-part of Ser. No. 79,190, Sep. 26, 1979, abandoned.

[51] Int. Cl.[3] ..... F41G 1/34; F21M 9/00; F21L 1/00

[52] U.S. Cl. ..... 362/188; 362/110; 362/191; 362/202; 362/419; 362/427

[58] Field of Search ..... 362/110, 111, 190, 191, 362/188, 202, 419, 427

[56] References Cited

U.S. PATENT DOCUMENTS

| | | | |
|---|---|---|---|
| 957,299 | 5/1910 | Barnes | 362/188 |
| 1,624,347 | 4/1927 | Lamont et al. | 362/111 |
| 1,699,595 | 1/1929 | Lamont | 362/111 |

FOREIGN PATENT DOCUMENTS

| | | | |
|---|---|---|---|
| 217521 | 2/1942 | Switzerland | 362/110 |
| 1385085 | 2/1975 | United Kingdom | 362/110 |

*Primary Examiner*—Irwin Gluck
*Attorney, Agent, or Firm*—Witherspoon & Hargest

[57] ABSTRACT

A flashlight holder is provided for attachment to a pistol, the holder positions the flashlight on the pistol whereby the flashlight may be horizontally and vertically adjusted so that its light beam will fall directly upon the object at which the gun is aimed.

9 Claims, 8 Drawing Figures

FLASHLIGHT GUN MOUNT

This application is a continuation-in-part of Ser. No. 79,190, filed Sept. 26, 1979, now abandoned.

BACKGROUND AND OBJECTS OF THE INVENTION

The flashlight mounting bracket assembly of this invention might very well be most aptly known as a safety device since it is adapted for attachment to a pistol or other firearm for alignment with the barrel bore whereby a light beam will be directed at the locus where the barrel is directed.

Many tragic incidents have been reported wherein the occupant of a house heard a noise and picked up his pistol and, without further investigation, fired the pistol only to find that the noise came from a friend trying to attract his attention. Needless to say, more care than this should be exercised before discharging a firearm at a mere noise or disturbance. It is apparent that lighting the area into which the gun is directed would be helpful in preventing the shooting by mistake of anyone. In other words, a gun should not be discharged until it has been determined at what the gun is directed. A flashlight adjustably attached to the gun will make such possible in a very simple and practical manner.

In view of the foregoing, it is an object of this invention to provide a flashlight holder assembly adapted for attachment to a pistol or other firearm.

It is another object of this invention to provide a flashlight holder adapted for attachment to a pistol and wherein two degrees of adjustability are available whereby the light beam from the flashlight may be adjusted so that its beam generally coincides with the line of sight of the pistol barrel bore.

It is yet another object of this invention to provide a flashlight holder of the character aforedescribed and comprising a minimum number of operating parts to accomplish the requisite needs.

The above and additional objects will become more apparent when taken in conjunction with the following detailed description and drawings covering two preferred embodiments of this invention.

IN THE DRAWINGS

FIG. 1 is an exploded perspective view of the flashlight holder of this invention, FIG. 2 is a front elevational view of the flashlight holder with the flashlight attached to a pistol and as seen from the barrel end of the pistol, FIG. 3 is a side elevational view of the combination of FIG. 2, and FIG. 4 is a rear elevational view of the combination of FIG. 2, looking from the butt end of the pistol, FIG. 5 is an exploded perspective view of the second embodiment of the flashlight holder of this invention, FIG. 6 is a front elevational view of the second embodiment with the flashlight and holder in operative position and as seen from the muzzle end of the pistol, FIG. 7 is a rear elevational view of the second embodiment with the flashlight and holder in operational position and as seen from the rear of the gun, and FIG. 8 is a side elevational view further illustrating the relation of the flashlight to the gun.

DETAILED DESCRIPTION OF THE INVENTION

Figure 4:
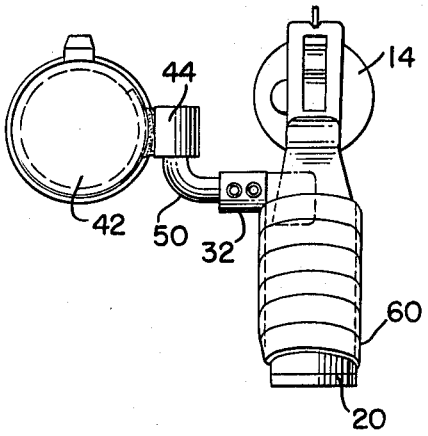
Figure 3:
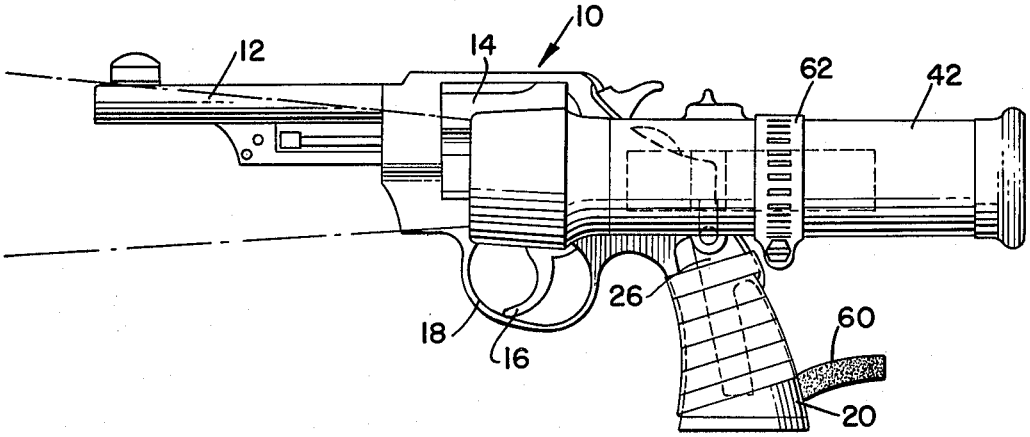
Figure 2:
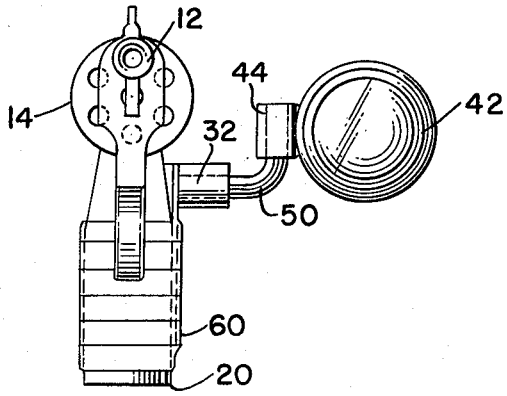

Referring to FIGS. 2–4, the pistol 10 is of the conventional type comprising a barrel 12, a rotating cartridge receiving chamber 14 which may be swung out for loading and unloading, a trigger 16 surrounded by trigger guard 18 and the hand grip or butt 20.

Figure 1:
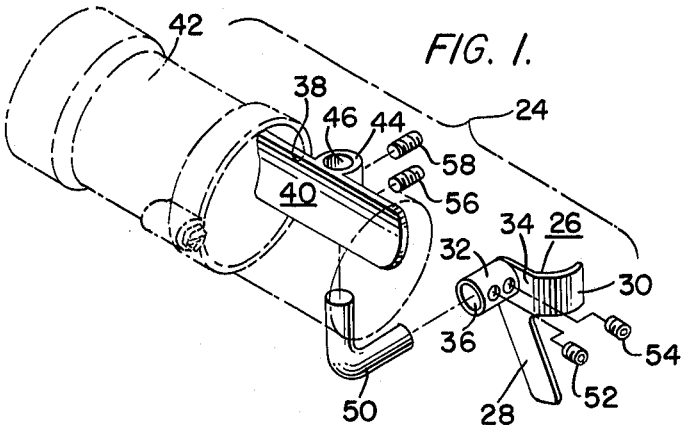

As illustrated in FIG. 1, the flashlight mounting bracket assembly 24 comprises a bracket 26 adapted for securement to the pistol butt 20 and includes a straight portion 28 with a curved portion 30 extending outwardly therefrom, said curved portion generally conforming to the curvature of the pistol butt 20. A first support 32 is secured to and extends outwardly from the outer free face 34 of the bracket 26 and is provided with a centrally positioned through-hole 36. The bracket assmebly 24 also includes a second bracket 38 having a longitudinal concavity 40 generally conforming to the usual configuration of the longitudinal body of the flashlight 42. The second bracket 38 has affixed thereto a second support 44 having a through-hole 46 generally perpendicular to the longitudinal axis of the second bracket 38.

The two brackets 26 and 38 are connected by an L-shaped pivot rod 50, one leg of the pivot rod fits into the through-hole 36 in first support 32 while the other end of the pivot rod fits in through-hole 46 of second support 44. A pair of set screws 52 and 54 are threadably mounted in the first support 32 and are adapted to engage the pivot rod portion within the through-hole 36 to fix the pivot rod with respect to the first support 32. Similarly, a pair of set screws 56 and 58 are threadably mounted in the second support 44 and are adapted to engage the pivot rod portion within the through-hole 46 to fix the position of the second bracket 38 with respect to the pivot rod 50.

The flashlight mounting bracket assembly 24 is assembled for use by first securing bracket 26 to the pistol butt 20 by means of tape 60 wound therearound as illustrated in FIGS. 2–4. The curved portion 30 of the bracket 26 fits smoothly on the curved portion of the pistol butt 20. With the bracket assembly 24 secured to the pistol butt 20, the flashlight is secured to bracket 38 by means of circular adjustable metal strip 62 as illustrated in FIG. 3.

The longitudinal position of the flashlight 42 with respect to the piston 10 is a matter of choice principally relating to balance since the pistol is a hand held weapon. As soon as the longitudinal portion of the flashlight with respect to the pistol has been achieved, it is then time to line up the light beam from the flashlight with respect to the bore sight of the pistol barrel 12. The vertical adjustment of the flashlight 42 is made by rotating the flashlight about the pivot pin portion positioned in first support 32. The horizontal adjustment is made by rotating the flashlight 42 about the pivot pin portion located in the second support 44. With the flashlight properly adjusted as set forth above the combination of flashlight and pistol is ready for use.

It should be noted that the flashlight mounting bracket assembly 24 may be affixed to either side of the pistol butt 20 to accommodate either right or left handed users. Further, the lengths of the respective legs of the L-shaped pivot rod 50 are such that linear displacement is also possible. Thus providing much more flexibility to the bracket assembly 24.

The second embodiment is illustrated in FIGS. 5—8 of the drawings. The pistol 100 is of the conventional design and includes a barrel 112, a rotating cartridge receiving chamber 114 which may be swung out for loading and unloading, a trigger 116 surrounded by trigger guard 118 and the hand grip or butt 120.

Figure 5:
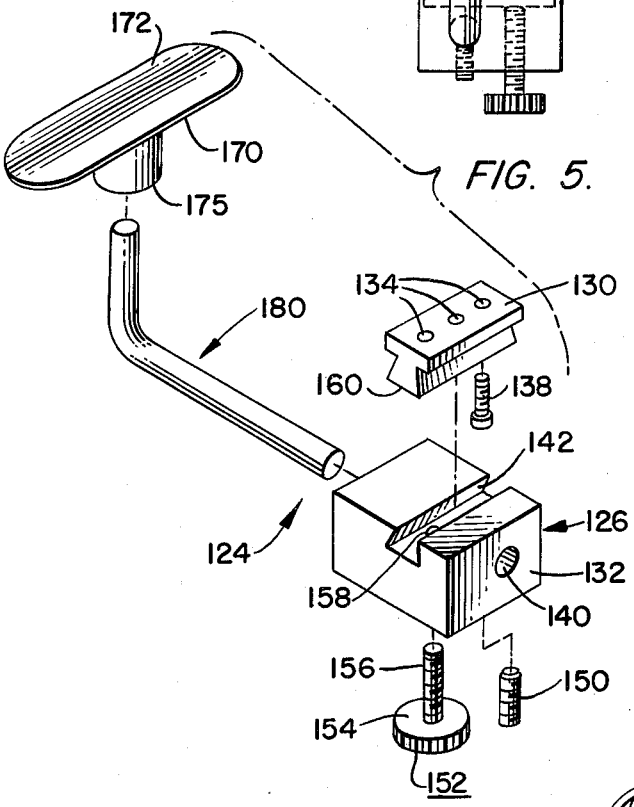
Figure 7:
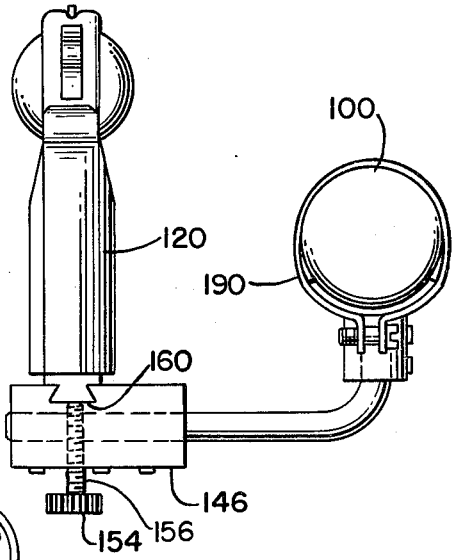
Figure 6:
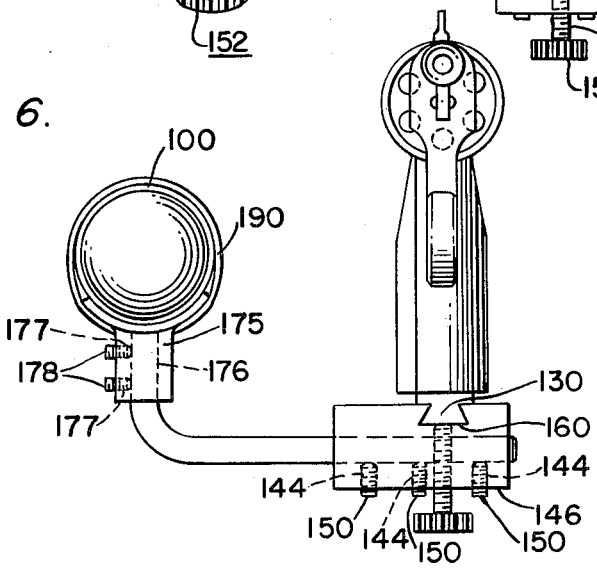

As best shown in perspective in FIG. 5, the second embodiment of the flashlight mounting bracket assembly 124 comprises a bracket assembly 126 adapted for securement to the pistol butt 120 and includes two interengaging members in the form of a dovetail joint comprising a flaring tenon member 130 and an appropriately configured mortise member 132. The tenon member 130 is provided with a plurality of vertical holes 134 which register with threaded holes in the bottom of the gun butt 120 to receive screws such as 138 to return the tenon member 130 firmly affixed to the gun butt as best illustrated in FIGS. 6 and 7.

The mortise member 132 is provided with a throughbore 140 running transversely to the mortise 142 therein. In addition the mortise member 132 has a plurality of threaded holes 144 extending between the bottom 146 of the mortise member 132 and intersecting the throughbore 140. The aforesaid threaded holes 144 threadably receive screws 150. In order to adjustably return the tenon member 130 and the mortise member 132 in adjusted and fixed position a set screw 152 is provided having a knurled head portion 154 and a threaded portion 156 extending perpendicularly therefrom which is threadably carried in threaded hole 158 running from the mortise member bottom 146 into the mortise 142 so that the screw may engage the underside 160 of the tenon member 130.

The curved bracket 170 and L-shaped pivot rod 180 are substantially like the bracket 38 and L-shaped pivot rod 50 of the first embodiment. More specifically, the curved bracket 170 has a longitudinally curved upper surface 170 somewhat conforming to the shape of a flashlight case 174. Curved bracket 170 has affixed thereto a second support 175 having a hole 176 and a pair of threaded holes 177 adapted to receive retaining screws 178.

Curved bracket 170 and dovetail bracket assembly 126 are connected by L-shaped pivot rod 180 with one end of such rod fitting in throughbore 140 and held therein by screws 150 while the other end of the rod 180 adjustably fits in hole 176 in second support 175 and is retained therein by screws 178.

Figure 8:
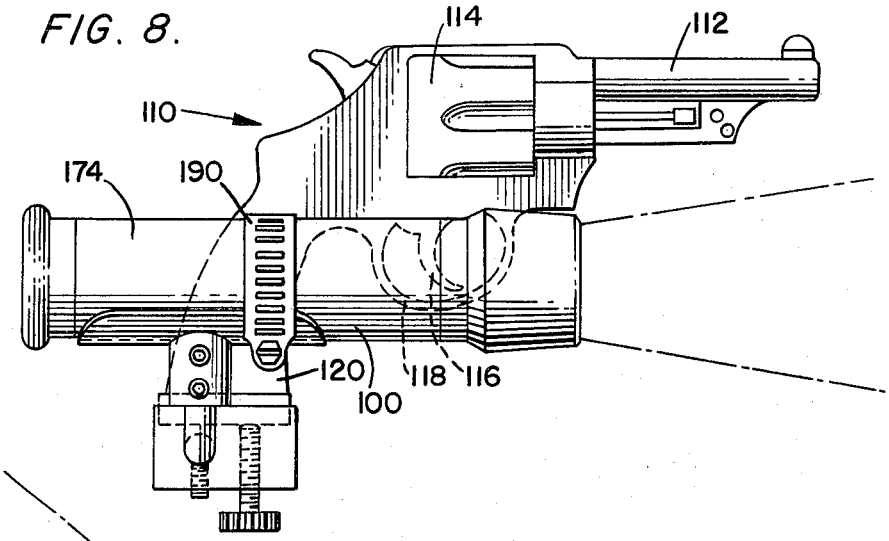

The second embodiment of the flashlight mounting is assembled for use by first attaching the tenon member 130 to the bottom of the gun butt 120 by means of screws 138. Next the long end of the L-shaped rod 180 is positioned within throughbore 140 of the mortise member 132 and secured therein by screws 150. After this the short end of the L-shaped rod 180 is placed in hole 176 in second support 175 and secured therein by means of set screws 178. The flashlight 100 is positioned on the curved surface 172 of the curved support 170 and secured thereto by means of adjustable clamp 190. Next, the mortise member 132 with all of the components mounted therein is assembled into the tenon member 130 so that the mounting bracket assembly 124 and the flashlight carried thereby appear as best shown in FIG. 8, then screw 152 is tightened to secure to the mortise and tenon member together.

As in the first embodiment, the bracket assembly provides two degrees of adjustability to the flashlight carried thereby. The flashlight 100 may be rotated about an axis of the throughbore 140 for vertical adjustment and may be rotated about the axis of hole 176 in second support 175 for horizontal adjustment.

One of the outstanding advantages of the second embodiment is that the tenor member 130 may be left on the gun butt bottom so that rapid assembly is possible. Further, the unusual arrangement of holes and the mortise 142 in its mortise member 132 provide utility for both sides of the gun.

It should be realized that there are many types of firearms on which the device of this invention could be used and it is intended that the scope of the claims should reflect such.

What is claimed is:

1. A flashlight mounting bracket assembly for adjustably mounting a flashlight on a gun whereby the beam of light produced by the flashlight may be adjusted so that it generally coincides with the line of sight taken through the bore of the gun barrel, said mounting bracket assembly comprising:

a first bracket and support means adapted for securement to the gun, a second bracket and suppoert means adapted for attachment to and for support of a flashlight, and pivot arm means comprising a rod-like portion bent at right angle to form an outwardly extending pair of arms at right angle to each other, one arm of the pivot arm being rotatably connected to the first bracket and support means, and the other arm being rotatably connected to the second bracket and support means whereby the flashlight held by the second bracket and support means has freedom of adjustability in the horizontal and vertical positions.

2. The invention as set forth in claim 1 and wherein the first bracket and support means includes a bracket configured to cooperate with the shape of that portion of the gun to which it is attached.

3. The invention as set forth in claim 2 and wherein the bracket configured to cooperate with the shape of that portion of the gun to which it is attached has a cylindrical bearing extending therefrom and said bearing rotatably mounts one arm of the pivot arm means.

4. The invention as set forth in claim 3 and wherein the second bracket and support means include a bracket configured to cooperate with the shape of the flashlight to which it is affixed.

5. The invention as set forth in claim 4 and wherein the bracket configured to cooperate with the shape of the flashlight to which it is affixed has a cylindrical bearing extending therefrom and said bearing rotatably carries one of the arms of the pivot arm means.

6. A flashlight mounting bracket assembly for adjustably mounting a flashlight on a pistol whereby the beam of light produced by the flashlight may be adjusted so that it generally coincides with the line of sight taken through the bore of the pistol barrel, said mounting bracket assembly comprising:

a first bracket adapted for securement to the handle of the pistol, a first support extending outwardly from the first bracket, said first support having a central opening extending generally perpendicular to the first bracket, a second bracket adapted for attachment to and for support of a flashlight, a second support extending outwardly from the exposed face of the second bracket, said second support having a central opening extending generally perpendicular to the second bracket, and pivot arm means comprising a rod-like portion bent at right angle to form an outwardly extending pair of arms at right angle to each other, one arm of the pivot arm fitting in the central opening in its first support and the other arm fitting in the opening in the second support whereby the flashlight held by the second bracket has freedom of adjustability in both the horizontal and vertical positions.

7. The invention as set forth in claim 1 and wherein the first bracket and support means comprises two interengaging bracket portions, one of which is attached to the gun, the other being interengaged with that attached to the gun, and rigidly connected to the support.

8. The invention as set forth in claim 7 and wherein the two interengaging bracket portions are of the dove tail configuration, with a bracket portion forming the flaring tenon and the other portion forming the cooperating mortise.

9. A flashlight mounting bracket assembly for adjustably mounting a flashlight on a pistol whereby the beam of light produced by the flashlight may be adjusted so that it generally coincides with the line of sight taken through the bore of the pistol barrel, said mounting bracket assembly comprising:

a first bracket combination comprising two portions forming a dovetail configuration one portion being adapted for securement to the handle of the pistol, second support having a central opening extending generally perpendicular to the second bracket, and pivot arm means comprising a rod-like portion bent at right angle to form an outwardly extending pair of arms at right angle to each other, one arm of the pivot arm fitting in the central opening in its first support and the other arm fitting in the opening in the second support whereby the flashlight held by the second bracket has freedom of adjustability in both the horizontal and vertical positions.

* * * * *